United States Patent [19]

Bauer

[11] Patent Number: 4,582,667

[45] **Date of Patent: * Apr. 15, 1986**

[54] TARGET ARRANGEMENT FOR SPALLATION-NEUTRON-SOURCES

[75] Inventor: Günter Bauer, Inden, Fed. Rep. of Germany

[73] Assignee: Kernforschungsanlage Jülich Gesellschaft mit beschränkter Haftung, Jülich, Fed. Rep. of Germany

[ * ] Notice: The portion of the term of this patent subsequent to Nov. 23, 1999 has been disclaimed.

[21] Appl. No.: 430,041

[22] Filed: Sep. 30, 1982

Related U.S. Application Data

[63] Continuation-in-part of Ser. No. 95,103, Nov. 16, 1979, Pat. No. 4,360,495.

[30] Foreign Application Priority Data

Nov. 18, 1978 [DE] Fed. Rep. of Germany ..... 2850069

[51] Int. Cl.[4] ..... G21G 1/10

[52] U.S. Cl. ..... 376/192; 376/151; 376/194; 376/202

[58] Field of Search ..... 376/151, 190, 191, 192, 376/193, 194, 199, 202, 430

[56] References Cited

U.S. PATENT DOCUMENTS

| | | | |
|---|---|---|---|
| 2,576,600 | 11/1951 | Hanson | 376/194 |
| 3,349,001 | 10/1967 | Stanton | 376/193 |
| 3,535,205 | 10/1970 | Bate et al. | 376/341 |
| 3,870,916 | 3/1975 | Küssel et al. . | |
| 3,966,547 | 6/1976 | Blue | 376/195 |
| 3,993,910 | 11/1976 | Parkin et al. . | |
| 4,090,086 | 5/1978 | Cranberg | 376/115 |
| 4,309,249 | 1/1982 | Steinberg et al. | 376/192 |
| 4,360,495 | 11/1982 | Bauer | 376/192 |

FOREIGN PATENT DOCUMENTS

| | | | |
|---|---|---|---|
| 2038074 | 7/1980 | United Kingdom | 376/192 |

OTHER PUBLICATIONS

R. Booth et al., "Rotating Target Neutron Generators", 1977, pp. 25–39 (from *Nuclear Instruments and Methods 145*).

Jinchoon Kim, "Neutron Sources Using D–T Mixed Beams Driven into Solid Target", 1977, p. 917 (from *Nuclear Instruments and Methods 145*).

The Uses of Cyclotrons in Chemistry, Metallurgy and Biology, 1969, Amphlett.

*Primary Examiner*—Deborah L. Kyle
*Assistant Examiner*—Richard W. Wendtland
*Attorney, Agent, or Firm*—Becker & Becker, Inc.

[57] ABSTRACT

A target arrangement for spallation-neutron-sources, according to which target material is continuously present at the point of incidence of a proton beam. The target material is arranged at the periphery of a rotary wheel which is internally cooled.

4 Claims, 9 Drawing Figures

TARGET ARRANGEMENT FOR SPALLATION-NEUTRON-SOURCES

Figure 1A:
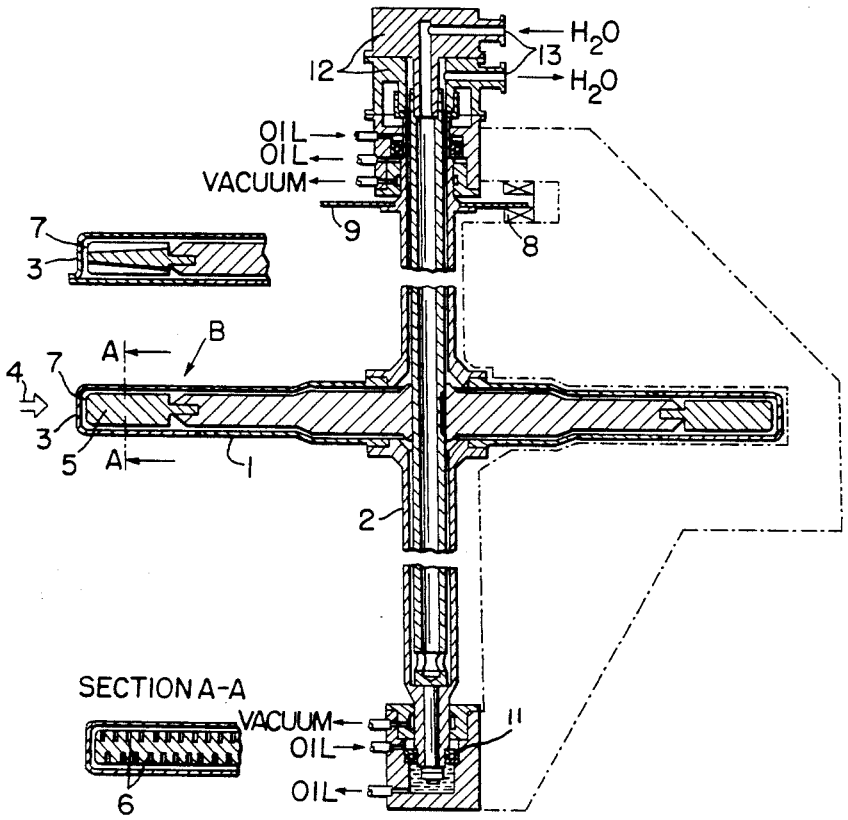

This is a continuation-in-part of co-pending parent application Ser. No. 95,103-Bauer filed Nov. 16, 1979 now U.S. Pat. No. 4,360,495.

The present invention relates to a target arrangement for spallation-neutron-sources, wherein target material is continuously present at the point of incidence of a proton beam, and heat removal is continuously effected.

With the most recent developments in acceleration technology of high proton streams (with the range of the order of mA) it has basically become feasible to utilize a spallation (nuclei evaporation) of heavy elements by energy-rich protons (approximately 1 GeV) for the construction of neutron-sources, which neutron-sources are equivalent, or even superior, in their thermal neutron-flow to a high flux reactor. Hereby, in comparison with such high-flux reactors, basic advantages are provided, for example, waiver of fissionable materials, substantially reduced production of radioactive, noble gases, and a substantially reduced potential of endangering the environment, because no critical arrangement is present.

Such spallation-neutron-sources could in future replace experimental reactors to a considerable extent and could also gain increasing importance as predecessors for electrical breeder installations. However, the problem of heat removal from the target needs to be satisfactorily resolved. The quantities of heat per unit, of the order of about 10 MW/1, attendant in a spallation target, lead to a rate of heating of the material of $10^4$ K/s and up, and, thus, present substantial difficulties.

Effective spallation-sources have not been built as yet. Pulsed neutron-sources, which can be considered predecessors, utilize water-cooled stationary target arrangements with quantities of heat per unit of several kW/1 in a timewise mean (J. M. Carpenter Nuc. Inst. Mat. 145 (1977), pages 91–112).

In accordance with a project proposal of 1966 (Bartholomev G. A and Tunnicliffe P. R., "The AECL-Study for an Intense Neutron Generator", Chalk River, AECL-2600 (1966)) it is suggested to introduce a proton beam vertically into a flowing target comprising liquid lead-bismuth-eutecticum, which is pumped at a high velocity (about 5 m/s) through a circuit. The circuit includes the target and a heat exchanger. Thus, a considerable quantity of liquid radioactive metals (several tons) must be kept in circulation. Up to the present, this concept has been considered to be the only solution of the problem. However, such an installation has the following drawbacks:

The proton beam, of an energy of 1 GeV and several milliamprees electric strength, has to be deflected into a vertical direction in order to avoid utilization of a stationary window into which a beam is shot (which window would be destroyed after a short period of time). This is difficult to attain and involves considerable effort.

The liquid metal circuit is dependent upon utilization of Pb-Bi-eutecticum. During spallation this causes production of the poisonous mercury isotope 194-Hg which is volatile and of long life, and production, by neutron capture in the bismuth, of the particularly undesirable polonium, undesirable because $\alpha$-active and volatile. Both could be avoided when using heavy metals with a high melting point, such as W or Ta.

For producing particularly high neutron fluxes it is desirable, under certain circumstances, to utilize the materials Th or U-238 which are fissionable by fast neutrons. Due to the respective high melting points, these can be used, again, only in their solid state.

The liquid metal circuit is technically very involved, very expensive, and, due to the stored energy quantity, potentially dangerous in the event of fracture of the highly strained conduits.

A retention of the reaction products in the liquid is not assured.

It is accordingly an object of the invention to provide a target arrangement which assures, to a high degree, flexibility in the selection of the target material and in which the target is a solid body so that the reaction products are retained to a large extent.

It is further an object of the invention to reduce, in comparison with the liquid metal circuit, the technical complexity and to provide an arrangement which allows the horizontal introduction of the proton beam.

It is also an object of the invention to efficiently remove the heat which results during operating of the target arrangement.

Figure 1B:
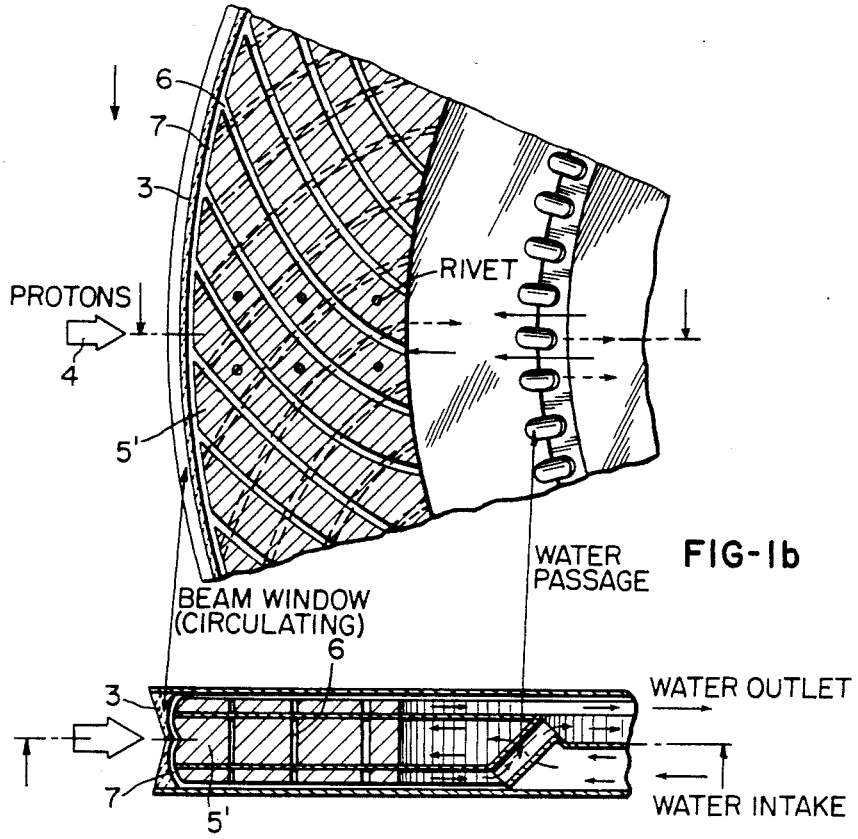
Figure 2A:
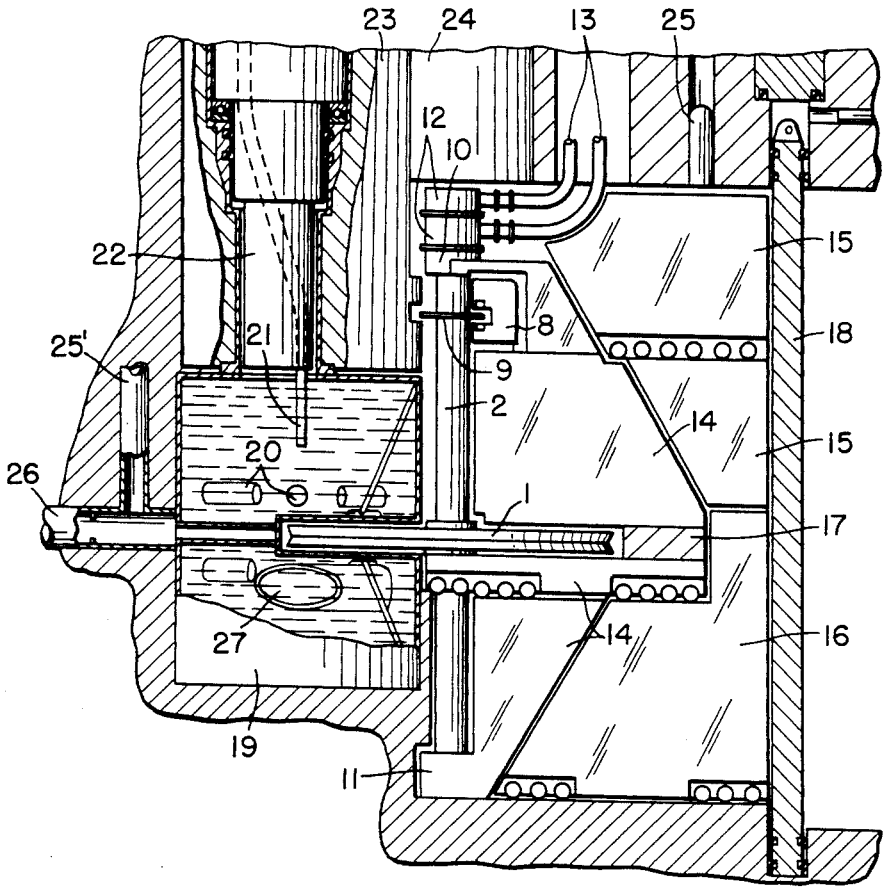
Figure 2B:
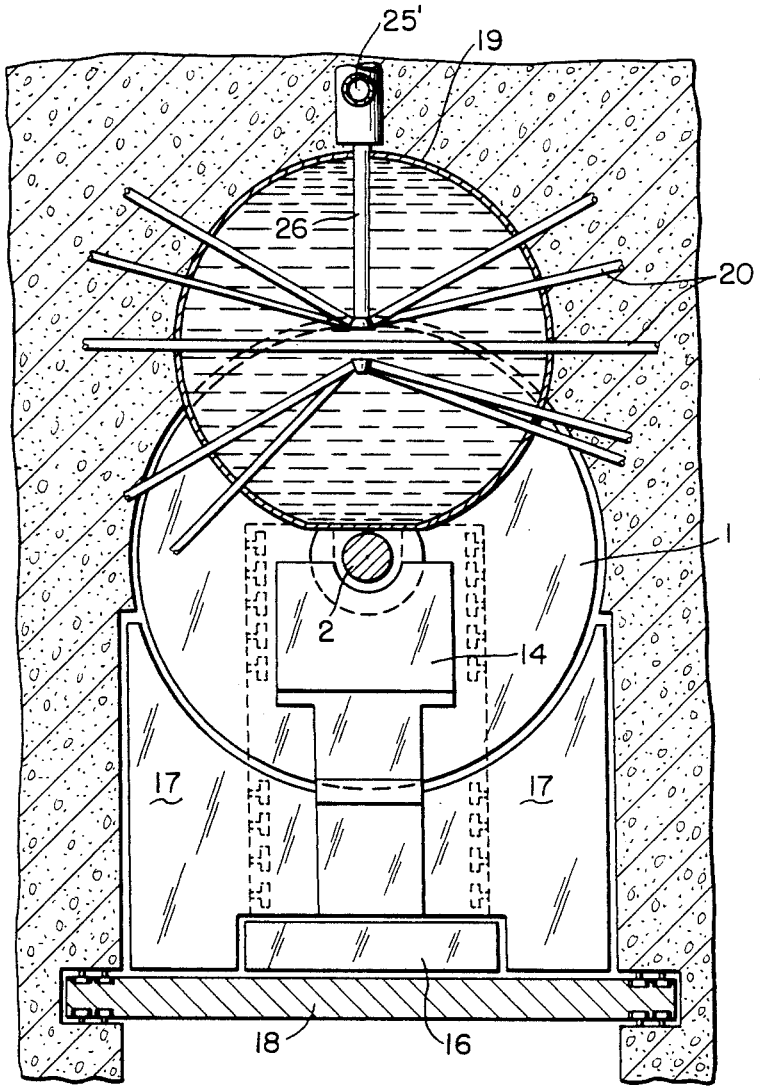
Figure 2C:
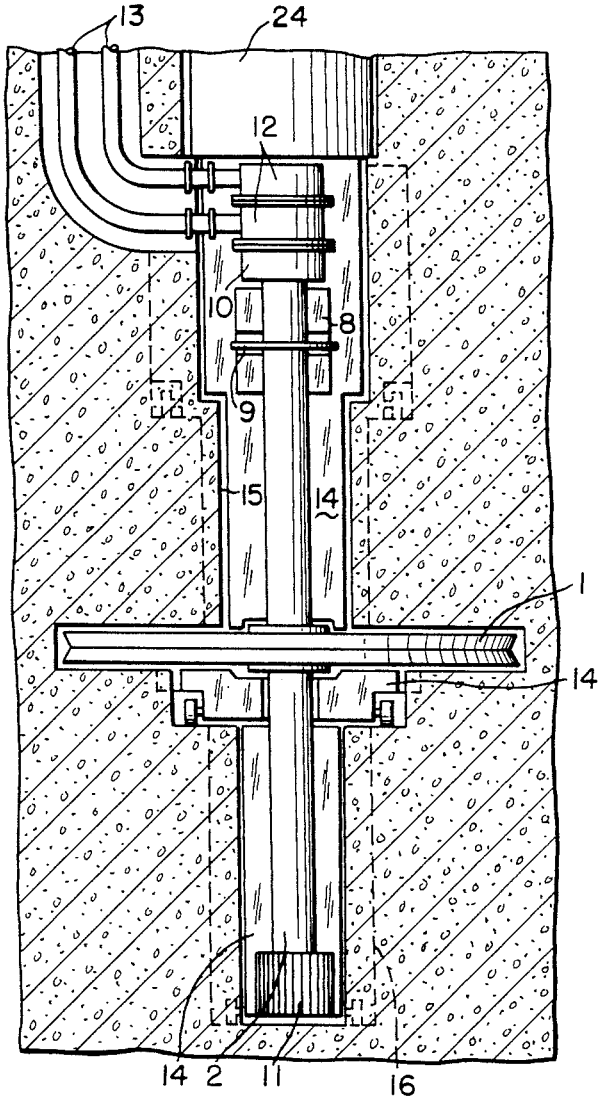
Figure 3A:
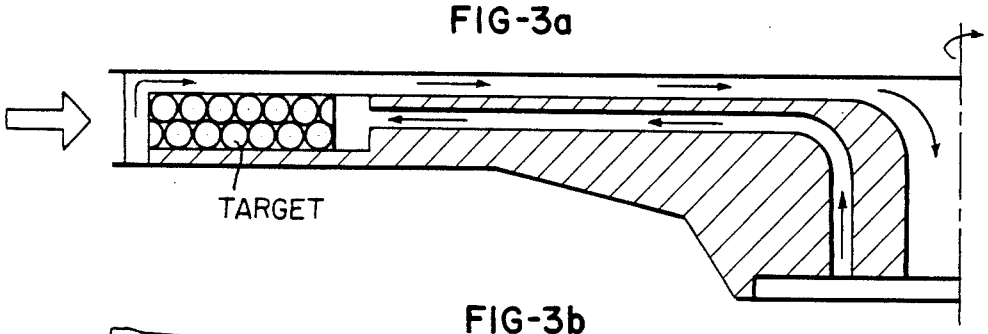
Figure 3B:
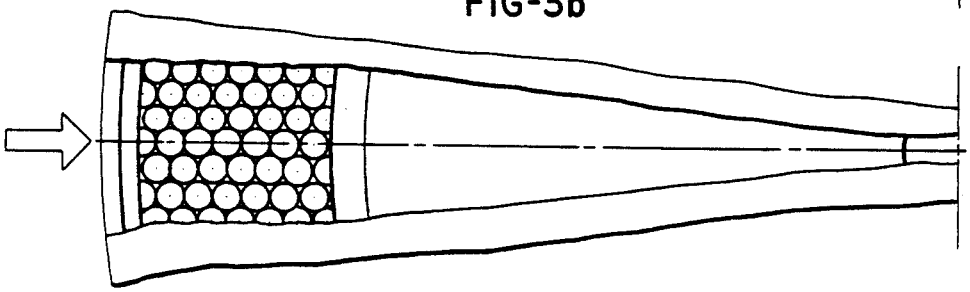
Figure 4A:
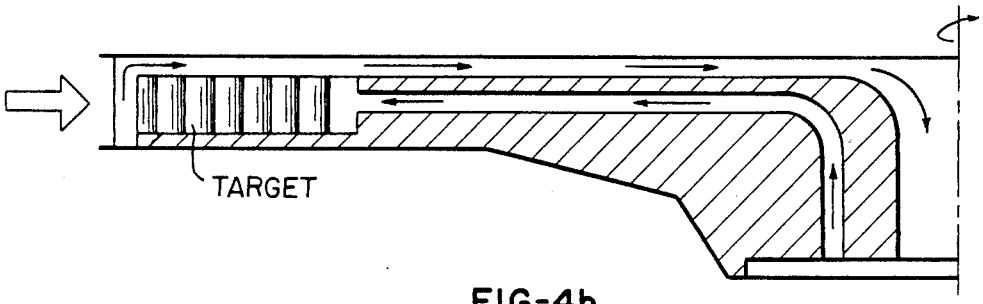
Figure 4B:
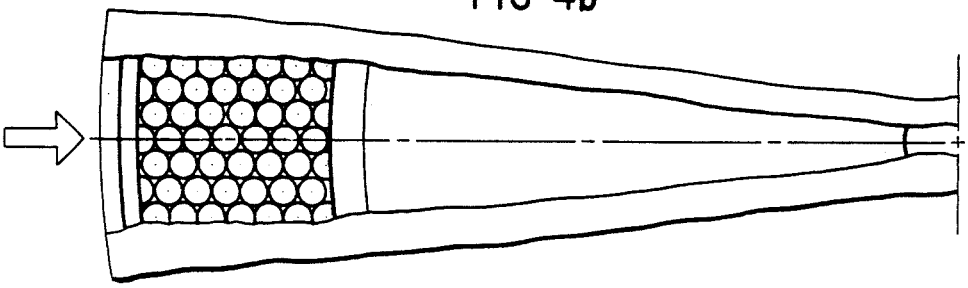

These objects and other objects and advantages of the invention will appear more clearly from the following specification in connection with the accompanying drawings, in which:

FIGS. 1*a* and 1*b* indicate diagrammatically the target arrangement according to one embodiment of the invention;

FIGS. 2*a*, 2*b* and 2*c* show the arrangement of the target in a spallation-neutron-source;

FIGS. 3*a* and 3*b* show fragmentary schematic illustrations of a target wheel arrangement with balls according to the present invention; and FIGS. 4*a* and 4*b* show fragmentary schematic illustration of a target wheel arrangement with cylindrical bodies according to the present invention.

The arrangement in accordance with the present invention is characterized primarily that the target material is arranged at the periphery of a rotary wheel or wheel structure which is internally cooled.

Preferably, the inner cooling of the wheel structure is achieved by delivering and removing the cooling medium, preferably water, through the shaft of the wheel structure, particularly the portion of the shaft which is arranged above the wheel structure, while simultaneously cooling the shaft bearings. The interior of the wheel structure is protected by a protective mantle against the surrounding vacuum in the vicinity of the acceleration channel. In the region of its generally cylindrical surface this outer mantle acts as the entry window for the proton beam and, accordingly, comprises particularly a metal having a low mass number, such as for example Al, Zr, or Ti in this region. This window is directly cooled by the cooling medium which is admitted through the wheel shaft; this cooling medium is further passed through the target material provided at the periphery of the wheel structure.

The window and target material are preferably provided in such a manner that they can be replaced. The actual target, of generally annular configuration, can also comprise individual ring segments, as well as cylindrical, spherical or other various shaped bodies.

The entire structure is operative in the column which is in operative connection with the volume of the proton tunnel. Since the pressure in the region of the wheel structure is approximately several magnitures greater than the pressure required in the proton tunnel, several valve locations are provided between which pumping can be carried out in a differential manner.

Various possibilities exist for the arrangement of the target material and the cooling passages therein. These are to be determined on the basis of a number of aspects, for example, mechanical and thermal loading, replaceability, cooling medium flow, and more. The simplest case of a solid ring, which ring is only externally surrounded by the cooling medium, is feasible in principle. However, due to the high heat conducting distances, about 3 cm at a 6 cm high target, temperatures of about 800° C. occur in the interior of the target. Such high temperatures are not even desirable for target materials having high melting points because of the decrease in mechanical strength. Accordingly, a split arrangement should be provided which is also advantageous considering disassembly in a "Hot Cell", and which avoids to a large extent the build-up of mechanical stresses.

In accordance with a preferred embodiment of the invention, the target material is provided with channels for the cooling medium; these channels, when viewed in plan, have an outline of an involute, with the curvature of each channel, when proceeding towards the periphery, being opposed to the direction of rotation of the wheel structure. The channels are adapted to communicate with the gap between the window and the target material. Returning of the cooling medium can be achieved by means of involute-curved cooling channels provided in the target material, or along the surrounding mantle surface, and correspondingly curved in the opposite direction.

For this purpose, the actual annular-like target can be provided with curved, particularly involute-curved, grooves. Alternatively, the target can include segments which are spaced from one another to provide the corresponding channels. For ease of assembly on the wheel, the segments can be provided with a footing. The arrangement of the target material, particularly with involute-curved grooves or channels, provides the advantage that within the interpositioned target material there is always provided the same heat path for the removal of the heat produced by the proton beam which is introduced into the system.

At the present time, it is particularly preferred to use a segment width of about 1 to 2 cm (in conformity with the heat removal conditions). The channels arranged between the segments have a width of about 1–2 mm. The assembly of the target of curved, particularly involute-curved, segments or "pseudosegments" (formed between the grooves) has furthermore the advantage that cooling channels can be provided which extend over the full height of the target material, without the proton beam being incident on areas, during the rotary movement of the wheel, which are free of, or practically devoid of, target material.

In order to avoid outward bending of the segments due to centrifugal forces in installations intended for high revolutions, sheet metal could be connected on and to the upper and lower surface of the segments.

The wheel structure is preferably arranged so that the axis of rotation extends perpendicular to the horizontal and so that its target material, arranged at the periphery, moves perpendicular to a proton beam which is introduced generally in the horizontal direction. The diameter of the wheel is preferably around 2.5 m. At rotational velocities of about 1 Hz it can then be achieved that the heat is sufficiently rapidly removed by material transport from the zone at which is is created, so that only a heating of less than about about 100 K is carried out. At a proton energy of about 1 GeV, for example, the circumferential velocity required for this amounts to about 2 m/s per MW of energy converted in the target. During further rotation the target material, which is generally cooled by a cooling medium, particularly water, is brought again to its starting temperature.

Referring now particularly to the drawings, according to FIG. 1*a*, a target arrangement is provided generally by a covered wheel 1 operatively connected to a shaft 2. Cooling medium is brought to the wheel disc and to the target ring and is, respectively, removed therefrom as is diagrammatically indicated in FIG. 1*b*.

The outer mantle of the wheel on its generally cylindrical surface provides a window 3 for the proton beam 4. This window can either be attached by screws or by welding. The further embodiment indicated in the upper portion of FIG. 1*a* provides for a simplified exchange or replacement of the window. The target material 5 is distributed along the periphery of the wheel and is provided with curved groove-like cooling channels as is indicated in Section A—A in FIG. 1*a*. Alternatively, these grooves can be provided by curved segments as it is generally indicated in FIG. 1*b*.

In accordance with FIG. 1*b*, the target material, composed of segments 5', includes cooling channels, passages or lines 6 which are preferably formed between the segments. The cooling medium is introduced into the cooling channels, these cooling channels being curved with a curvature which, when proceeding towards the periphery, is opposed to the direction of rotation of the wheel structure. Next, the cooling medium, while being assisted by the attendant centrifugal force, extends into the gap 7 between target 5 and window 3, the latter being intensively cooled in this manner. Return of the cooling medium is achieved either by curved channels, curved in the opposite direction within the target, or by cooling channels or gaps arranged along the mantle of the wheel. In the lower portion of FIG. 1*b*, the path of the cooling medium is indicated within the wheel disc. This wheel disc can include a support structure (in which cooling channels for delivering cooling medium are arranged), as indicated in FIG. 1*a*, or this wheel disc can be substantially hollow, whereby the respective embodiments are determined by stability demands. The connection of segments, shown in FIG. 1*b*, includes a "surface" connection of segments having varying directions of curvature. This provides the advantage that bending in an outward direction of the segments is substantially prevented. The layered structure as illustrated, furthermore, provides the possibility for using a heterogeneous target, since the central segments can be of the material of the spallation target and the outer layers can be made of the medium which provides for multiplication of neutrons (for example Be). Should fissionable material be used, the central part can be of U-238 (or, due to its easier workability, improved heat conductivity, and absence of phase transitions: of thorium) and the outer (Be—) segments can be covered with a layer of about 20% enriched uranium having a thickness of about 1–2 mm in which the recirculating or returning thermal neutrons are nearly completely absorbed and utilizable for fission. Again, the outer segments can be made of Be in this case, in order to utilize, at energies above 2 MeV, the n—2n processes, and to achieve a certain reflector effect for the fission neutrons.

The arrangement of a target with a vertically arranged axis of rotation in a spallation-neutron-source is diagrammatically indicated in FIGS. 2*a*–2*c* which generally show the arrangement of such a source (FIG. 2*a*), with the attendant arrangement of target material and the proton beam, and the beam tubes, respectively, in plan view (FIG. 2*b*), and the arrangement of the rotary target and its arrangement in the moderator tank (FIG. 2*c*).

As is evident, the proton beam enters through the periphery of the wheel. Neutrons released in the target exit then at the upper side and lower side of the target and enter into a moderator arranged thereat (for example $D_2O$) where they are thermalized. The beam or radiation tubes are then respectively arranged in a plane above and below the target wheel thus avoiding or substantially reducing high energy neutron contamination in the extracted thermal neutron beam.

In particular, FIG. 2*a* shows the rotary target 1 with the water-guiding shaft 2, a drive stator 8 and a drive rotor 9. Numerals 10 and 11 designate, respectively, a loose and a fixed shaft bearing. Rotary transmissions 12 provide for delivery of and removal of water, carried out at 13. Numeral 14 designates a bearing block. Protection for the system includes an upper movable cover 15, a lower movable cover 16, and a cover 17 arranged at the level of the target. A gate 18 which is adapted to maintain a vacuum can be moved on rails, not shown.

In the moderator tank 19 there are arranged radiation tubes 20 and a nozzle or blow pipe 21 of the low temperature irradiation installation. A rotary plug 22 allows varying the irradiation position of the low temperature irradiation facility. In the upper region there is provided the upper protective cover 23 of the moderator tank 19, a removable plug 24, and a pump conduit 25 for producing a high vacuum. A position for an optional proton irradiation facility in front of the neutron target is also provided in the proton tunnel 26. Numeral 27 designates a radiation tube for introducing of a cold neutron-source.

The conduit 13 for delivering and removing water is shown offset at 90° in the drawing.

In comparison to a liquid metal target in accordance with the present state of the art, the rotary internally cooled target provides the following advantages:

Absolute flexibility in the selection of target material. This allows either:

utilization of nuclear fissioning for multiplication of neutrons (target material: U or Th); or avoiding of production of transuranium products by utilization of Pb or Bi which are characterized by a low absorption cross section for thermal neutrons, whereby also the production of the volatile heavy metals Hg and Po has to be taken into account; or utilization of Ta or W as target materials whereby neither transuranium products nor Hg and Po are formed which, however, provide for a somewhat reduced neutron flux.

Avoiding of a liquid metal circuit and the attendant technical effort and danger potential.

Avoiding the necessity of a vertical proton introduction, practical realization for streams of a few mA of which is questionable however or, in any event provides a considerable technical and economical effort.

In contrast to fixed targets already in use or under construction, the foregoing rotary target as described in accordance with the present invention for spallation-sources has many advantages. Particularly there is avoided the taxing fluid metal cooling system considered necessary for the considerable quantity of heat involved.

This invention is also in contrast to the known state of the art since the target material is arranged annularly at the periphery or circumference of a rotating wheel or disc so that it may be impinged by a horizontal proton beam. However, no overheating can arise since passages are provided throughout the wheel and the target material whereby a liquid coolant may flow continuously over, under and around the target material to prevent any accumulation of heat.

The target material, which is arranged at the periphery of the wheel, takes up about one quarter to one half of the wheel radius. It is, as indicated in greater detail hereinabove, preferably in the form of curved target segments or "pseudo-segments" which provides the following advantages in comparison to a solid target ring:

Reduction of thermal stresses;

optimization of flow of cooling medium;

increase of the cooling surfaces;

minimization of the length of distance for heat conduction;

simplified assembly and, respectively, disassembly in the activated condition.

The thickness of the segments will depend on the particular application. Preferred are targets having a "layered structure" comprising segments for delivering and removing, as it is indicated in the lower portion of FIG. 1*b*. The curvature of the segments in the region of outflow is opposite to the direction indicated for the inflow. Motive power is, for example, provided by a disc-running-motor.

Aside from the variations of the rotary target with internal cooling, particularly by gap-like channels, of course, other embodiments with appropriately arranged bores (for cooling medium transport) in the target ring are feasible, as are also arrangements of target material in the shape of balls (if required, with two different diameters) about which cooling medium flows. The target ring can also be provided by a (non-pumped) liquid metal which can be cooled by means of conduits through which cooling medium flows.

FIG. 3*a* illustrates target material which is composed of roller bodies having the shape of spherical- or ball-shaped segments while FIG. 4*a* illustrates target material having the shape of cylindrical bodies. These balls or cylinders are positioned in side by side relationship to one another, but there exists between these balls or cylinders a predetermined minimum spacing or distance. These intermediate spaces, which are clearly indicated in FIGS. 3*b* and 4*b*, allow the coolant to flow throughout the target material, thereby preventing overheating.

Additionally, according to a further variation, the ball intermediate spaces or chambers are filled with small but "non-fitting" balls which, on the other hand, maintain the through-passages and, on the other hand, lie in the path of the proton beam, which thereby additionally impinges upon the material.

This type or manner of dividing the volume of a rotating target ring is capable of being carried out in an especially simple manner and is mechanically dependable or reliable.

It is readily recognizable from the drawing illustrations that the cooling passages are so located and placed that the heatpath lengths are always equal. Also readily apparent from the drawings is the thickness of the target material. Whatever shape the target material takes, the thickness of the target material segments contained around the wheel remains substantially constant. As mentioned earlier the thickness of these segments will depend upon the particular application.

Since the spacing or distance between the target segments, which is provided for the cooling medium, must be considered neglible in comparison to the amount of space occupied by the target segment and since the number of such segments in the path of the beam is large, the impinging proton beam will always encounter the same amount of target material, at any given time therefore maintaining a steady output.

In other words, the coolant channels are arranged throughout the target material in such a way that the same amount of target material will always be exposed to the proton beam. Therefore, no matter which area of the wheel's periphery may be passing the proton beam, the amount of exposed target material will remain constant.

In summary, the present invention provides a target arrangement for a spallation-neutron source having a rotatable target wheel which has target material for a proton beam being positioned around its periphery. The target material is provided with curved channels or spaces throughout the target material to allow for internally cooling the wheel during its rotation. As the wheel rotates, target material continuously passes the point of impact with the proton beam, while coolant is circulated through the channels. The arrangement of the channels in the target material is such that the proton beam continuously encounters substantially the same amount of target material.

The present invention is, of course, in no way restricted to the specific disclosure of the specification and drawings, but also encompasses any modifications within the scope of the appended claims.

I claim:

1. In a spallation-neutron target arrangement having a proton beam which continuously impinges on the target, the arrangement comprising:

a rotatable wheel which is provided with target material around its periphery, said proton beam being directed toward said target material during rotation of said wheel, and said target material being composed of layers of target segments disposed in side by side relationship in such a way as to form therebetween intermediate spaces which communicate with one another to form curved channels which receive a coolant.

2. A target arrangement according to claim 1, in which said target segments are in the form of balls.

3. A target arrangement according to claim 1, in which said target segments are in the form of cylinders.

4. A target arrangement according to claim 1, in which the amount of said target material is substantially the same along any given radius of said wheel.

* * * * *